US010426238B2

(12) United States Patent
Kim

(10) Patent No.: US 10,426,238 B2
(45) **Date of Patent: *Oct. 1, 2019**

(54) CASE HAVING DOUBLE THERMOPLASTIC POLYURETHANE LAYERS FOR ELECTRONIC DEVICES

(71) Applicant: SPIGEN KOREA CO., LTD., Seoul (KR)

(72) Inventor: Dae-Young Kim, Seoul (KR)

(73) Assignee: SPIGEN KOREA CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/851,004

(22) Filed: Dec. 21, 2017

(65) Prior Publication Data

US 2018/0110304 A1 Apr. 26, 2018

Related U.S. Application Data

(62) Division of application No. 15/240,939, filed on Aug. 18, 2016, now Pat. No. 9,872,546.

(60) Provisional application No. 62/218,283, filed on Sep. 14, 2015, provisional application No. 62/210,416, filed on Aug. 26, 2015, provisional application No. 62/206,787, filed on Aug. 18, 2015.

(51) Int. Cl.
*A45C 11/00* (2006.01)
*A45C 13/36* (2006.01)

(52) U.S. Cl.
CPC ..... *A45C 11/00* (2013.01); *A45C 13/36* (2013.01); *A45C 2011/002* (2013.01); *A45C 2011/003* (2013.01); *A45C 2200/10* (2013.01)

(58) Field of Classification Search
CPC . A45C 13/36; A45C 13/002; A45C 2011/002; A45C 11/00; A45C 2011/003
USPC ..... 206/320, 586, 521
See application file for complete search history.

(56) References Cited

U.S. PATENT DOCUMENTS

| | | | |
|---|---|---|---|
| 8,430,240 | B2 | 4/2013 | Kim |
| 8,439,191 | B1 | 5/2013 | Lu |
| 8,695,798 | B2 | 4/2014 | Simmer |
| 8,706,176 | B1 | 4/2014 | Jia |

(Continued)

OTHER PUBLICATIONS

TECH21, "Evo Band Case Apple Iphone 6 Plus/ 6s Plus", https://www.tech21.com/en_us/evo-band-case-for-apple-iphone-6-plus-6s-plus, Downloaded Aug. 18, 2016.

(Continued)

*Primary Examiner* — Steven A. Reynolds
(74) *Attorney, Agent, or Firm* — Heedong Chae; Lucem, PC

(57) ABSTRACT

A case for an electronic device includes: a protective cover having a side wall wherein the side wall significantly covers a side portion of the electronic device and the side wall includes an inner surface and an outer surface wherein the inner surface faces the electronic device and a longitudinal recess is formed on the inner surface; and a longitudinal insert member removably received in the longitudinal recess. The longitudinal insert member includes an inner wall and an outer wall and the inner wall faces the electronic device. The longitudinal insert member is provided with a plurality of holes and the holes are separated by a plurality of partitions. The structure by the holes is effective in protecting the electronic device from impact or shock.

14 Claims, 22 Drawing Sheets

(56) References Cited

U.S. PATENT DOCUMENTS

| | | | | |
|---|---|---|---|---|
| 9,025,317 | B2 * | 5/2015 | Richardson | H04M 1/0252 361/679.01 |
| 9,072,353 | B2 * | 7/2015 | Fathollahi | A45C 13/002 |
| D747,707 | S | 1/2016 | Roberts et al. | |
| D747,708 | S | 1/2016 | Roberts et al. | |
| 9,293,808 | B1 | 3/2016 | Roberts | |
| D753,641 | S | 4/2016 | Roberts et al. | |
| D754,651 | S | 4/2016 | Roberts et al. | |
| D754,652 | S | 4/2016 | Roberts et al. | |
| D756,344 | S | 5/2016 | Roberts et al. | |
| D756,345 | S | 5/2016 | Roberts et al. | |
| D757,704 | S | 5/2016 | Roberts et al. | |
| 9,526,320 | B2 | 12/2016 | Roberts | |
| 2007/0158220 | A1 * | 7/2007 | Cleereman | A45C 11/00 206/320 |
| 2010/0096284 | A1 * | 4/2010 | Bau | H04B 1/3888 206/320 |
| 2011/0095033 | A1 | 4/2011 | Hung | |
| 2011/0297578 | A1 | 12/2011 | Stiehl | |
| 2012/0018325 | A1 | 1/2012 | Kim | |
| 2012/0217257 | A1 | 8/2012 | Ting | |
| 2012/0305422 | A1 | 12/2012 | Vandiver | |
| 2013/0098788 | A1 | 4/2013 | McCarville | |
| 2013/0193006 | A1 | 8/2013 | Bergreen | |
| 2013/0235323 | A1 | 9/2013 | Sotzing et al. | |
| 2014/0008260 | A1 * | 1/2014 | Kanaya | H04M 1/0283 206/459.5 |
| 2014/0076746 | A1 | 3/2014 | Richardson et al. | |
| 2014/0138265 | A1 | 5/2014 | Bong | |
| 2014/0224675 | A1 | 8/2014 | Simmer | |
| 2014/0268516 | A1 | 9/2014 | Fathollahi et al. | |
| 2015/0068935 | A1 | 3/2015 | Kay | |
| 2015/0076020 | A1 | 3/2015 | Smith | |
| 2015/0076186 | A1 | 3/2015 | Wong | |
| 2015/0194995 | A1 | 7/2015 | Fathollahi | |

OTHER PUBLICATIONS

TECH21, "Evo Elite Case Apple Iphone 6 Plus/ 6s Plus", https://www.tech21.com/en_us/evo-elite-case-for-apple-iphone-6-plus-6s-plus, Downloaded Aug. 18, 2016.

TECH21, "Evo Mesh Case Apple Iphone 6 Plus/ 6s Plus", https://www.tech21.com/en_us/evo-mesh-case-for-apple-iphone-6-plus-6s-plus, Downloaded Aug. 18, 2016.

TECH21, "Evo Mesh Sport Case Apple Iphone 6 Plus/ 6s Plus", https://www.tech21.com/en_us/evo-mesh-sport-case-for-apple-iphone-6-plus-6s-plus, Downloaded Aug. 18, 2016.

TECH21, "Evo Tactical Case Apple Iphone 6 Plus/ 6s Plus", https://www.tech21.com/en_us/evo-tactical-case-for-apple-iphone-6-plus-6s-plus, Downloaded Aug. 18, 2016.

TECH21, "Evo Tactical XT Case Apple Iphone 6 Plus/ 6s Plus", https://www.tech21.com/en_us/evo-tactical-xt-case-for-apple-iphone-6-plus-6s-plus, Downloaded Aug. 18, 2016.

TECH21, "Evo Wallet Case Apple Iphone 6 Plus/ 6s Plus", https://www.tech21.com/en_us/evo-wallet-case-for-apple-iphone-6-plus-6s-plus, Downloaded Aug. 18, 2016.

TECH21, "Impact Clear Case Apple Iphone 6 Plus/ 6s Plus", https://www.tech21.com/en_us/impact-clear-case-for-apple-iphone-6-plus-6s-plus, Downloaded Aug. 18, 2016.

TECH21, "Patriot Case Apple Iphone 6 Plus/ 6s Plus", https://www.tech21.com/en_us/patriot-case-for-apple-iphone-6-plus-6s-plus, Downloaded Aug. 18, 2016.

TECH21, "Evo Band Case Apple Iphone 6/ 6s", https://www.tech21.com/en_us/evo-band-case-for-apple-iphone-6-6s, Downloaded Aug. 18, 2016.

TECH21, "Evo Check Case Apple Iphone 6/ 6s", https://www.tech21.com/en_us/evo-check-case-for-apple-iphone-6-6s, Downloaded Aug. 18, 2016.

TECH21, "Evo Elite Case Apple Iphone 6/ 6s", https://www.tech21.com/en_us/evo-elite-case-for-apple-iphone-6-6s, Downloaded Aug. 18, 2016.

TECH21, "Evo Endurance Charging Case Apple Iphone 6/ 6s", https://www.tech21.com/en_us/evo-endurance-charging-case-for-apple-iphone-6-6s, Downloaded Aug. 18, 2016.

TECH21, "Evo Mesh Case Apple Iphone 6/ 6s", https://www.tech21.com/en_us/evo-mesh-case-for-apple-iphone-6-6s, Downloaded Aug. 18, 2016.

TECH21, "Evo Mesh Sport Case Apple Iphone 6/ 6s", https://www.tech21.com/en_us/evo-mesh-sport-case-for-apple-iphone-6-6s, Downloaded Aug. 18, 2016.

TECH21, "Evo Tactical Case Apple Iphone 6/ 6s", https://www.tech21.com/en_us/evo-tactical-case-for-apple-iphone-6-6s, Downloaded Aug. 18, 2016.

TECH21, "Evo Tactical XT Case Apple Iphone 6/ 6s", https://www.tech21.com/en_us/evo-tactical-xt-case-for-apple-iphone-6-6s, Downloaded Aug. 18, 2016.

TECH21, "Evo Wallet Case Apple Iphone 6/ 6s", https://www.tech21.com/en_us/evo-wallet-case-for-apple-iphone-6-6s, Downloaded Aug. 18, 2016.

TECH21, "Evo Xplorer Case Apple Iphone 6/ 6s", https://www.tech21.com/en_us/evo-xplorer-case-for-apple-iphone-6-6s, Downloaded Aug. 18, 2016.

TECH21, "Impact Clear Case Apple Iphone 6/ 6s", https://www.tech21.com/en_us/impact-clear-case-for-apple-iphone-6-6s, Downloaded Aug. 18, 2016.

TECH21, "Patriot Case Apple Iphone 6/ 6s", https://www.tech21.com/en_us/patriot-case-for-apple-iphone-6-6s, Downloaded Aug. 18, 2016.

TECH21, "Evo Mesh Case Apple Iphone 5/ 5s/ SE", https://www.tech21.com/en_us/evo-mesh-case-for-apple-iphone-5-5s-se, Downloaded Aug. 18, 2016.

TECH21, "Evo Tactical Case Apple Iphone 5/ 5s/ SE", https://www.tech21.com/en_us/evo-tactical-case-for-apple-iphone-5-5s-se, Downloaded Aug. 18, 2016.

TECH21, "Impact Clear Case Apple Iphone SE", https://www.tech21.com/en_us/impact-clear-case-for-apple-iphone-se, Downloaded Aug. 18, 2016.

TECH21, "Patriot Case Apple Iphone 5/ 5s/ SE", https://www.tech21.com/en_us/patriot-case-for-apple-iphone-5-5s-se, Downloaded Aug. 18, 2016.

* cited by examiner

100

CASE HAVING DOUBLE THERMOPLASTIC POLYURETHANE LAYERS FOR ELECTRONIC DEVICES

CROSS-REFERENCE TO RELATED APPLICATIONS

This application is a Divisional application of and claims priority to U.S. Utility patent application Ser. No. 15/240,939, filed Aug. 18, 2016, which claims priority to U.S. provisional patent Applications No. 62/206,787, filed Aug. 18, 2015, U.S. provisional patent application No. 62/210,416, filed Aug. 26, 2015, and U.S. provisional patent application No. 62/218,283, filed Sep. 14, 2015, the disclosures which are incorporated herein by reference.

FIELD OF THE INVENTION

The present invention relates to a case, having double thermoplastic polyurethane layers, for electronic devices and, more particularly, to a case having a first thermoplastic polyurethane layer and a second thermoplastic polyurethane layer for covering a side portion of an electronic device. The first thermoplastic polyurethane layer is transparent or translucent whereas the second thermoplastic polyurethane layer has a vivid color so that the second thermoplastic polyurethane layer is visible through the first thermoplastic polyurethane layer. The first and second thermoplastic polyurethane layers have a shock absorbing structure.

SUMMARY OF THE INVENTION

The present invention contrives to solve the disadvantages of the prior art. The present invention provides a case for an electronic device such as a mobile phone, a smart phone, a tablet, computer or other portable computing devices, and, more particularly, to a case having first and second thermoplastic polyurethane layers.

The object of the present invention is to provide a case for an electronic device, comprising: a protective cover having a side wall, wherein the side wall significantly covers a side portion of the electronic device and the side wall comprises an inner surface and an outer surface wherein the inner surface faces the electronic device and a longitudinal recess is formed on the inner surface; and a longitudinal insert member removably received in the longitudinal recess, the longitudinal insert member comprises an inner wall and an outer wall and the inner wall faces the electronic device. The longitudinal insert member is provided with a plurality of holes and the holes are separated by a plurality of partitions. The structure by the holes is effective in protecting the electronic device from impact or shock. The side wall of the protective cover forms the first thermoplastic polyurethane layer and the longitudinal insert member forms the second thermoplastic polyurethane layer. The side wall is transparent or translucent whereas the longitudinal insert member has a vivid color so that the longitudinal insert member is visible through the side wall. Preferably, the longitudinal insert member significantly covers the side portion of the electronic device and covers the four corners of the side portion of the electronic device. The four corners are especially vulnerable to impact or shock and need to be protected by the double layered structure of the present invention.

Another object of the present invention is to provide a case for an electronic device, comprising: a protective cover having a side wall wherein the side wall significantly covers a side portion of the electronic device and the side wall comprises an inner surface and an outer surface wherein the inner surface faces the electronic device and a longitudinal recess is formed on the inner surface; and a longitudinal insert member removably received in the recess. The longitudinal insert member comprises an inner surface and an outer surface and the inner surface of the insert member faces the electronic device. The outer surface of the longitudinal insert member is provided with a plurality of depressions longitudinally arranged and the structure by the depressions is effective in protecting the electronic device from impact or shock. The side wall of the protective cover forms the first thermoplastic polyurethane layer and the longitudinal insert member forms the second thermoplastic polyurethane layer. The side wall is transparent ox translucent whereas the longitudinal insert member has a vivid color so that the longitudinal insert member is visible through the side wall. Preferably, the longitudinal insert member significantly covers the side portion of the electronic device and covers the four corners of the side portion of the electronic device. The four corners are especially vulnerable to impact or shock and need to be protected by the double layered structure of the present invention.

Still another object of the present invention is to provide a case having a longitudinal insert member removably received in the longitudinal recess. The longitudinal insert member comprises an inner wall, an outer wall, a top wall and a bottom wall so that the longitudinal insert member forms a cylindrical tube.

The advantages of the present invention are: (1) the case of the present invention has a double-layered thermoplastic polyurethane structure by the side wall and longitudinal insert member and thus, it provides better protection to an electronic device; (2) the insert member has holes or depressions and the structure by the holes or depressions efficiently absorbs or spreads impacts from outside; (3) because of the double-layered thermoplastic polyurethane structure, various stylish designs have become possible, for example, white thermoplastic polyurethane could not be used for a case because it easily gets dirty, but white thermoplastic polyurethane can be used by using the present invention of the double-layered thermoplastic polyurethane structure; (4) the hole or depression structure not just effectively protects an electronic device, but also enables various stylish designs by aligning the holes or depressions in a stylish way; (5) the side wall is transparent or translucent whereas the longitudinal insert member has a vivid color so that the longitudinal insert member is visible through the side wall; (6) the longitudinal insert member significantly covers the side portion and four corners of the electronic device for better protection of the side wall and four corners, which are especially vulnerable to shock or impact; and (7) because of retaining members, the insert member is securely held in the recess.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 5B shows the mating structure;

DETAILED DESCRIPTION EMBODIMENTS OF THE INVENTION

Reference will now be made in detail to the preferred embodiments of the present invention, examples of which are illustrated in the accompanying drawings, which form a part of this disclosure. It is to be understood that this invent ion is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 6:
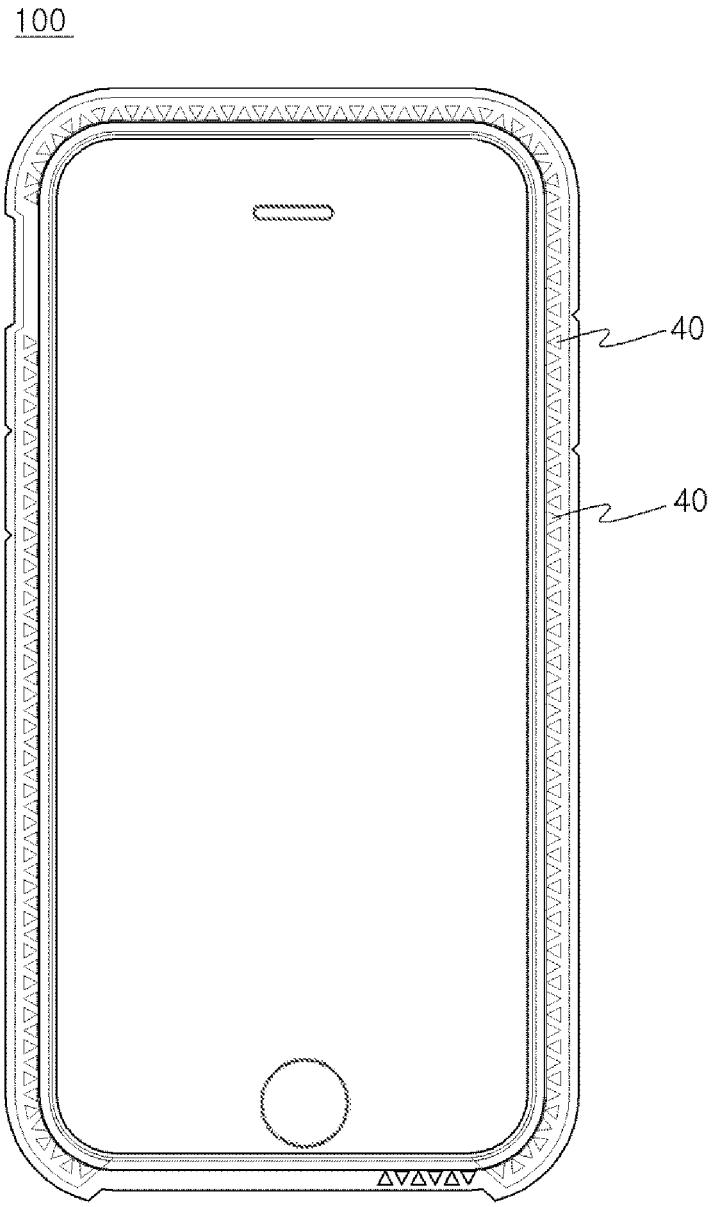
FIG. 6 shows a front view of the case according to another embodiment of the present invention.

FIGS. 1~5 show one embodiment of the present invention and FIG. 6 shows another embodiment of the present invention. FIGS. 7~11B show still another embodiment of the present invention.

Figure 1:
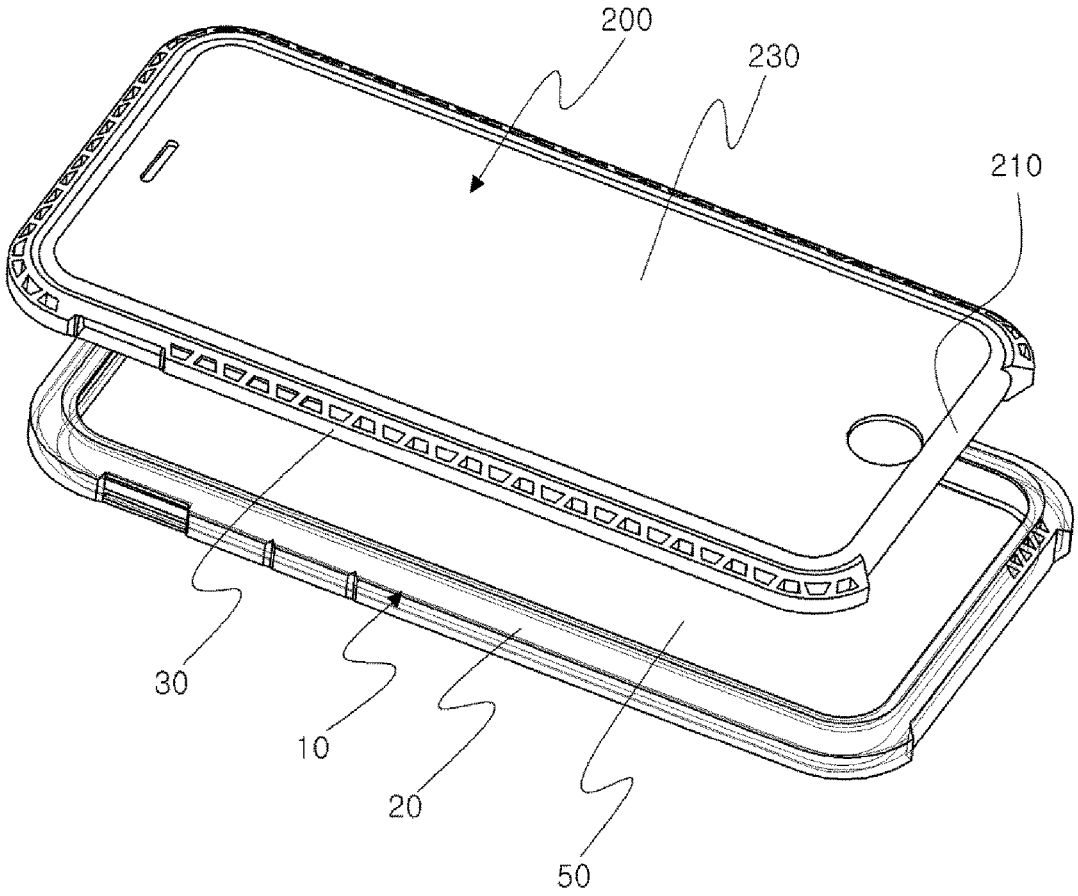
FIG. 1 shows an exploded perspective view of a case and an electronic device installed therein according to one embodiment of the present invention.
Figure 2:
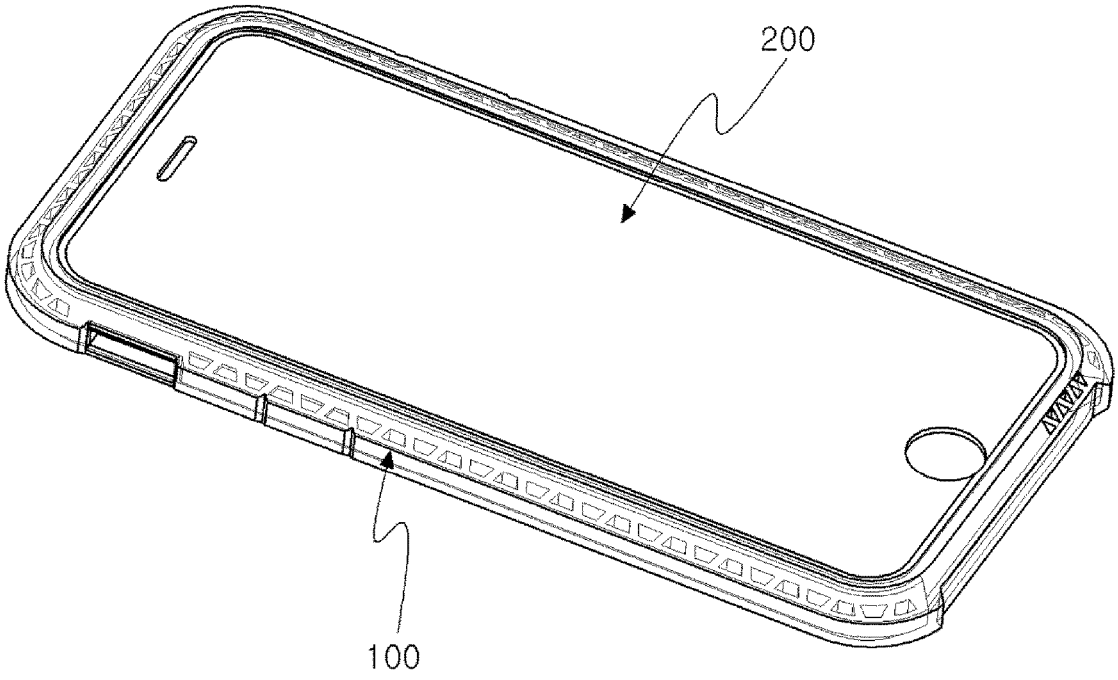
FIG. 2 shows a perspective view of the case and electronic device installed therein.

FIG. 1 shows an exploded perspective view of a case 100 and an electronic device 200 installed therein. FIGS. 2~5 respectively show exploded perspective, assembled perspective, front, rear, and cross-sectional views including enlarged views of the case of the present invent ion.

The case 100 for an electronic device 200 comprises: a protective cover 10 having a side wall 20 wherein the side wall 20 significantly covers a side portion 210 of the electronic device 200 and the side wall 20 comprises an inner surface 21 and an outer surface 22 wherein the inner surface 21 faces the electronic device 200 and a longitudinal recess 23 is formed on the inner surface 21; and a longitudinal insert member 30 removably received in the recess 23. The longitudinal insert member 30 comprises an inner wall 31 and an outer wall 32 and the inner wall 31 faces the electronic device 200. The longitudinal insert member 30 is provided with a plurality of holes 40 and the holes 40 are separated by a plurality of partitions 45.

The inner surface 21 is in contact with the outer wall 32. In addition, both of the inner surface 21 and the outer wall 32 are curved as shown in the figures including the cross sectional views.

The inner and outer walls 31, 32 of the longitudinal insert member 30 are substantially parallel to each other and the holes 40 are formed by the inner and outer walls 31, 32 and the partitions 45, wherein the holes 40 have a trapezoidal or substantially trapezoidal cross section so that the holes 40 form a series of trapezoidal or substantially trapezoidal holes 40. Here, trapezoidal hole means having a cross section of trapezoid and "parallel" include not just straight portion but also curved portion that the inner and outer walls 31, 32 do not meet. Preferably, the cross section is isosceles trapezoidal.

Figure 3:
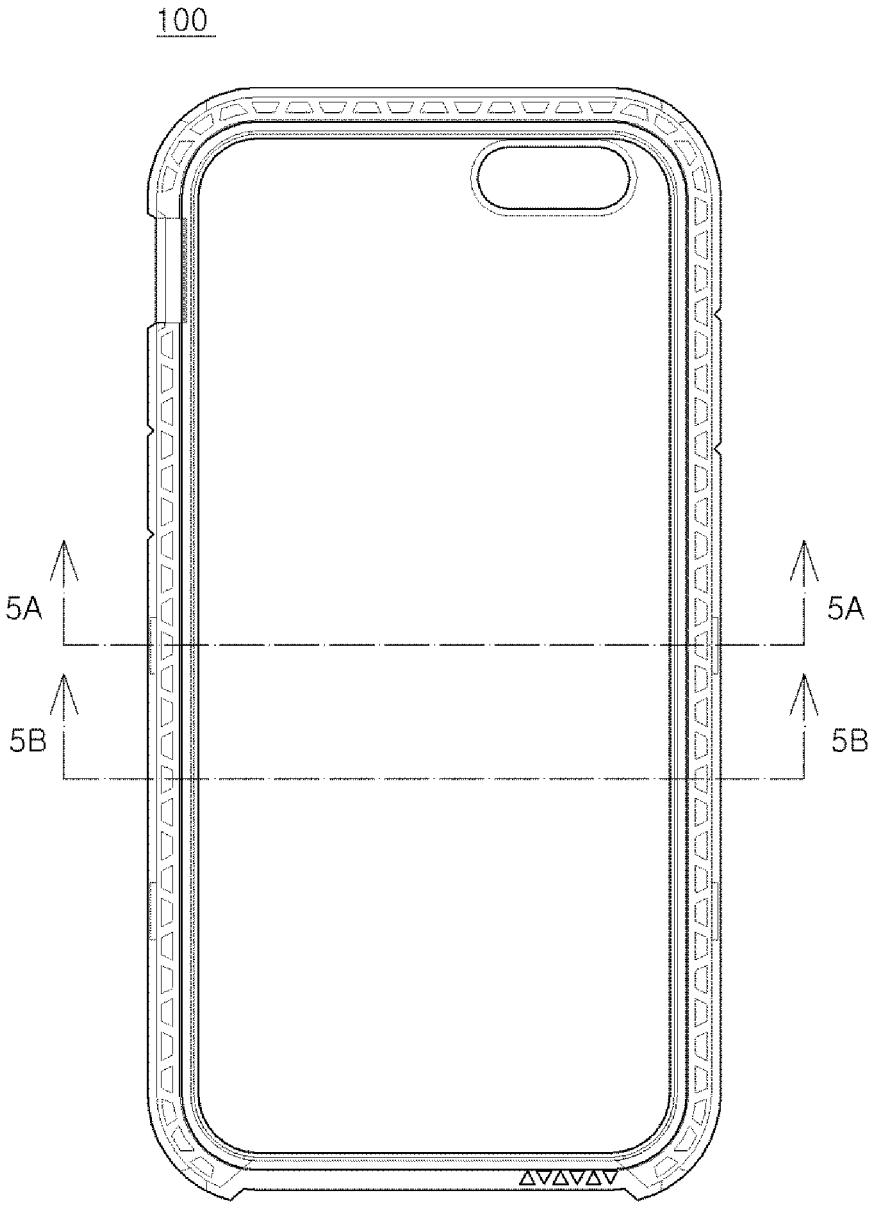
FIG. 3 shows a front view of the case.
Figure 4:
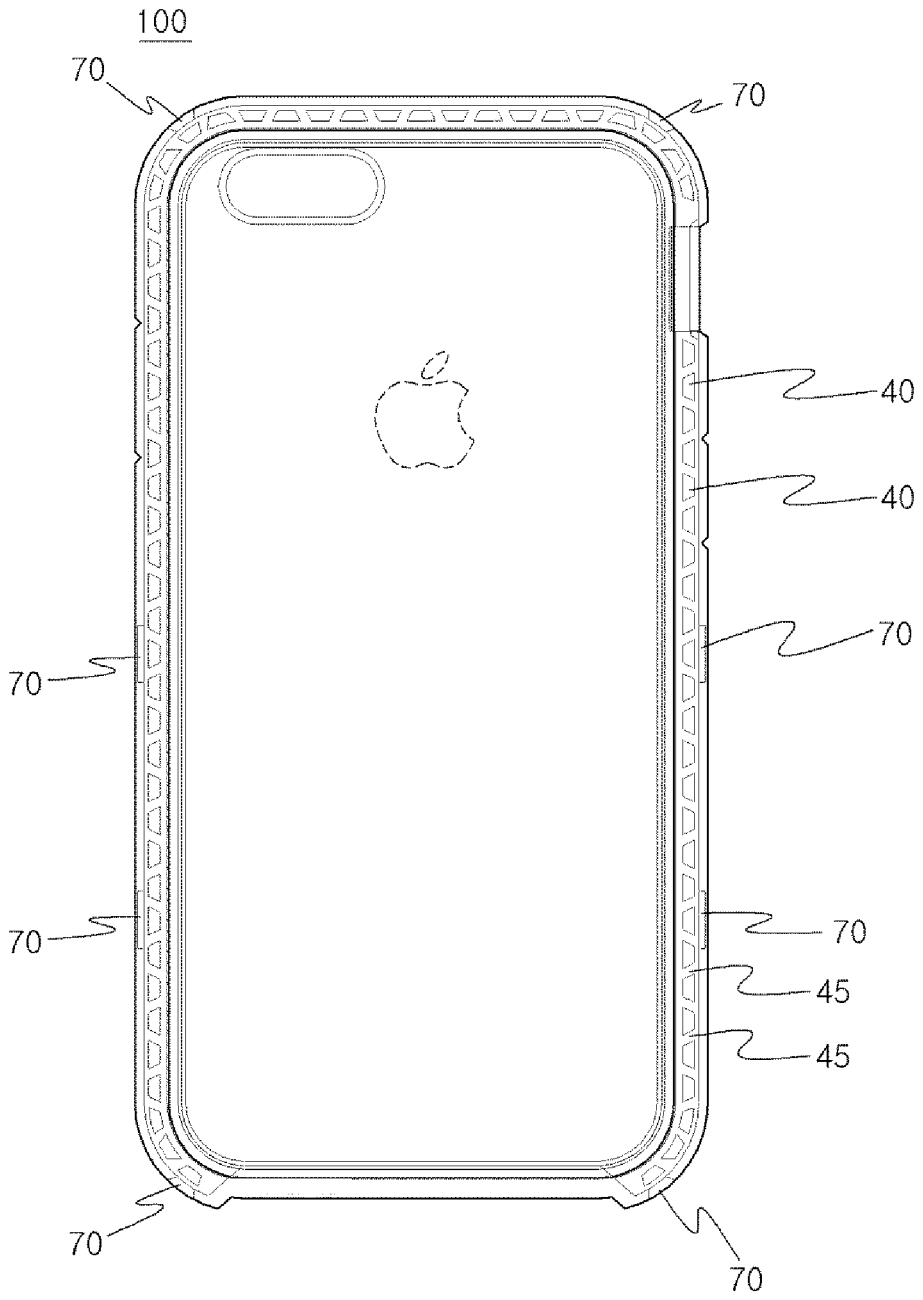
FIG. 4 shows a rear view of the case.
Figure 5A:
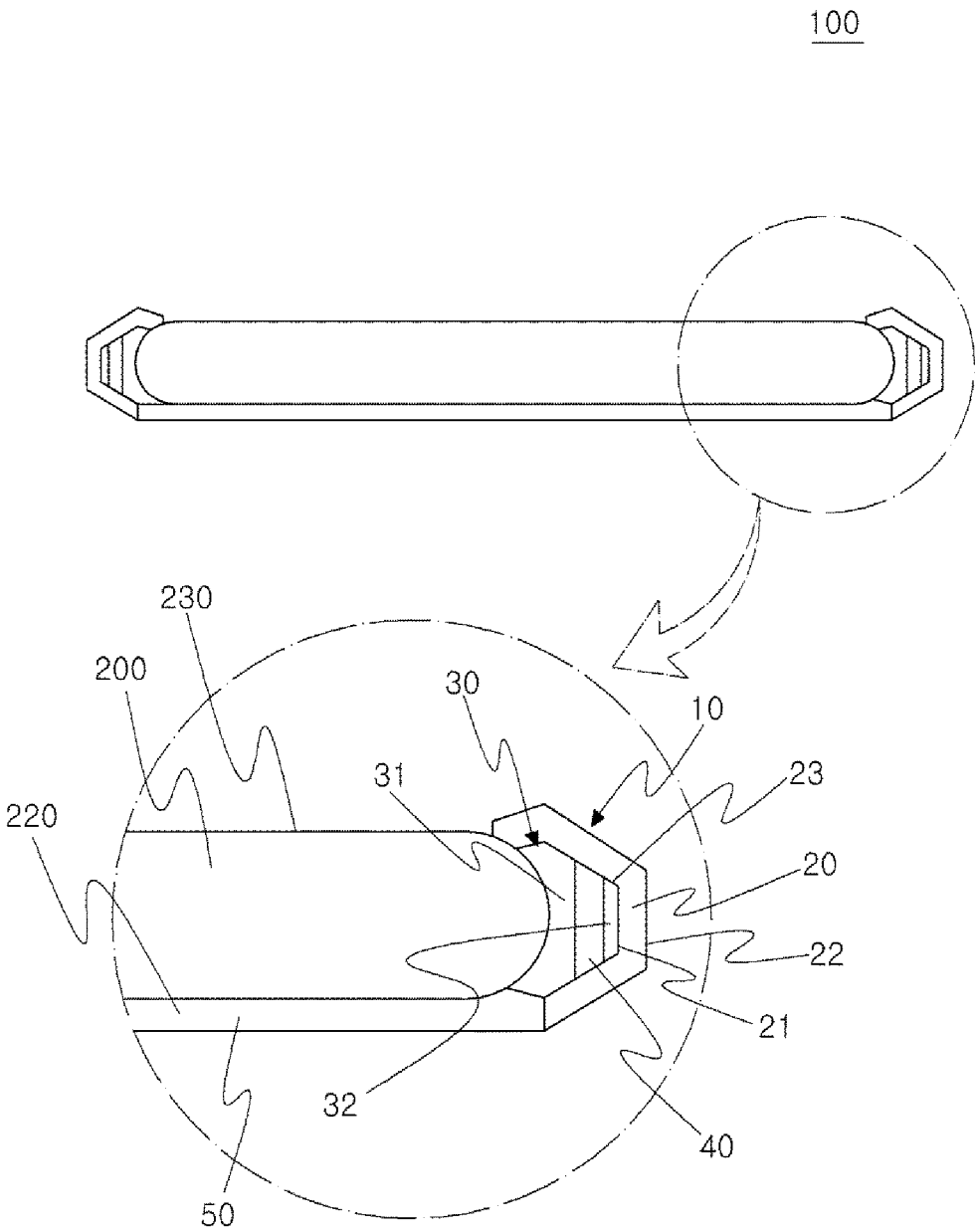
FIGS. 5A and 5B show cross sectional views of the case—including enlarged cross sectional views—of the case where
Figure 5B:
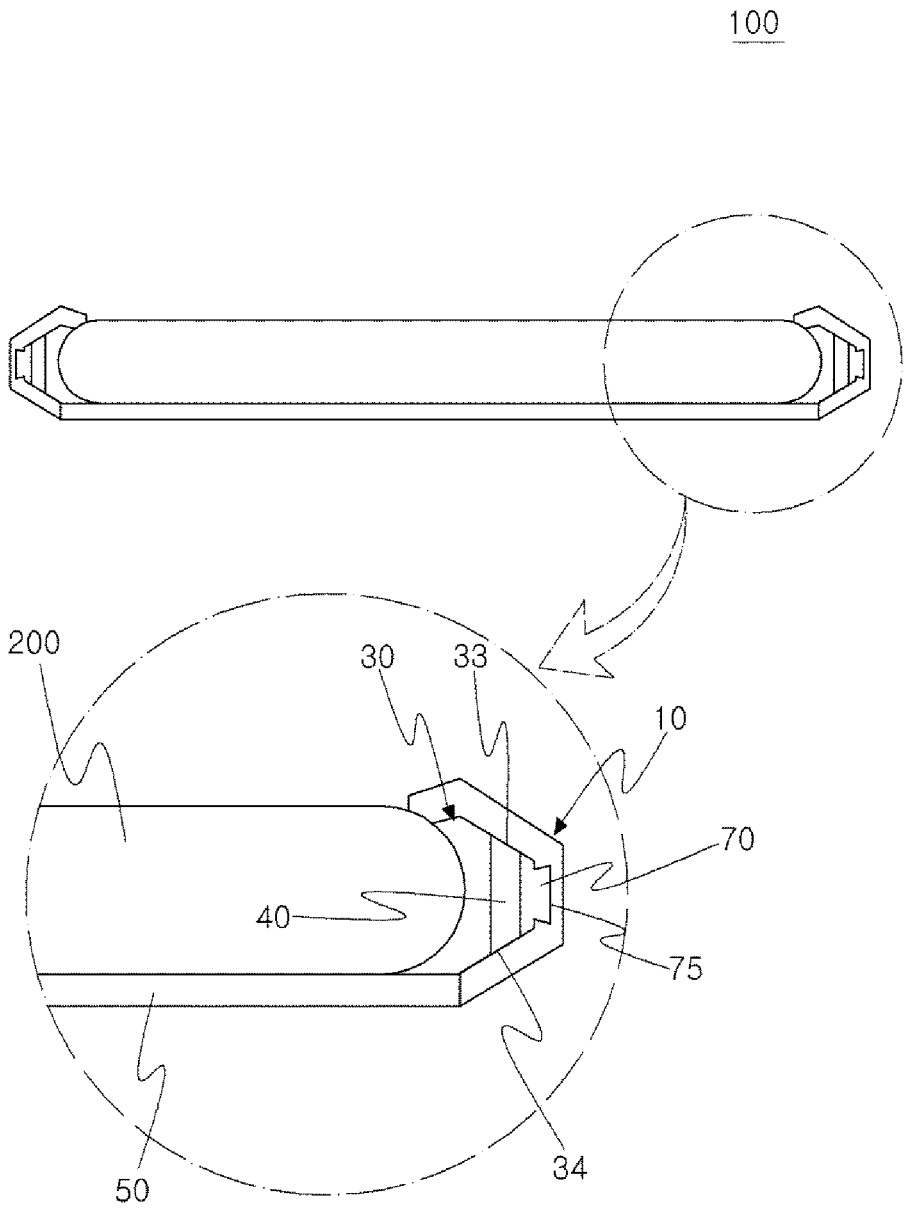

The trapezoidal or substantially trapezoidal cross sections of the holes 40 are symmetrical or substantially symmetrical. Most of the holes 40 may have a trapezoidal or substantially trapezoidal cross section. Here, "most" means "more than half", and thus, more than half of the holes have a trapezoidal or substantially trapezoidal dross section. In FIG. 3, substantially all the holes have a trapezoidal cross section, except the ones at the bottom which have a triangular cross section.

In the alternative, the inner and outer walls 31, 32 of the longitudinal insert member 30 are substantially parallel to each other and the holes 40 are formed by the inner and/or outer walls 31, 32 and the partitions 45, wherein the holes 40 have a triangular or substantially triangular cross section so that the holes 40 form a series of triangular or substantially triangular holes 40. The triangular or substantially triangular cross sections of the holes 40 are symmetrical or substantially symmetrical. In addition, most of the holes 40 may have a triangular or substantially triangular cross section, or as shown in FIG. 6, substantially all of the holes 40 may have a triangular or substantially triangular cross section.

In another alternative, the inner and outer walls 31, 32 of the longitudinal insert member 30 are substantially parallel to each other and the holes 40 are formed by the inner and outer walls 31, 32 and the partitions 45, wherein the holes 40 have a rectangular or substantially rectangular cross section so that the holes 40 form a series of rectangular or substantially rectangular holes 40. The rectangular or substantially rectangular cross sections of the holes 40 are symmetrical or substantially symmetrical as in FIG. 21. Most of the holes 40 may have a rectangular or substantially rectangular cross section.

In still another alternative, the holes may have a mixture of the trapezoidal holes, triangular holes, and rectangular holes.

Figure 14:
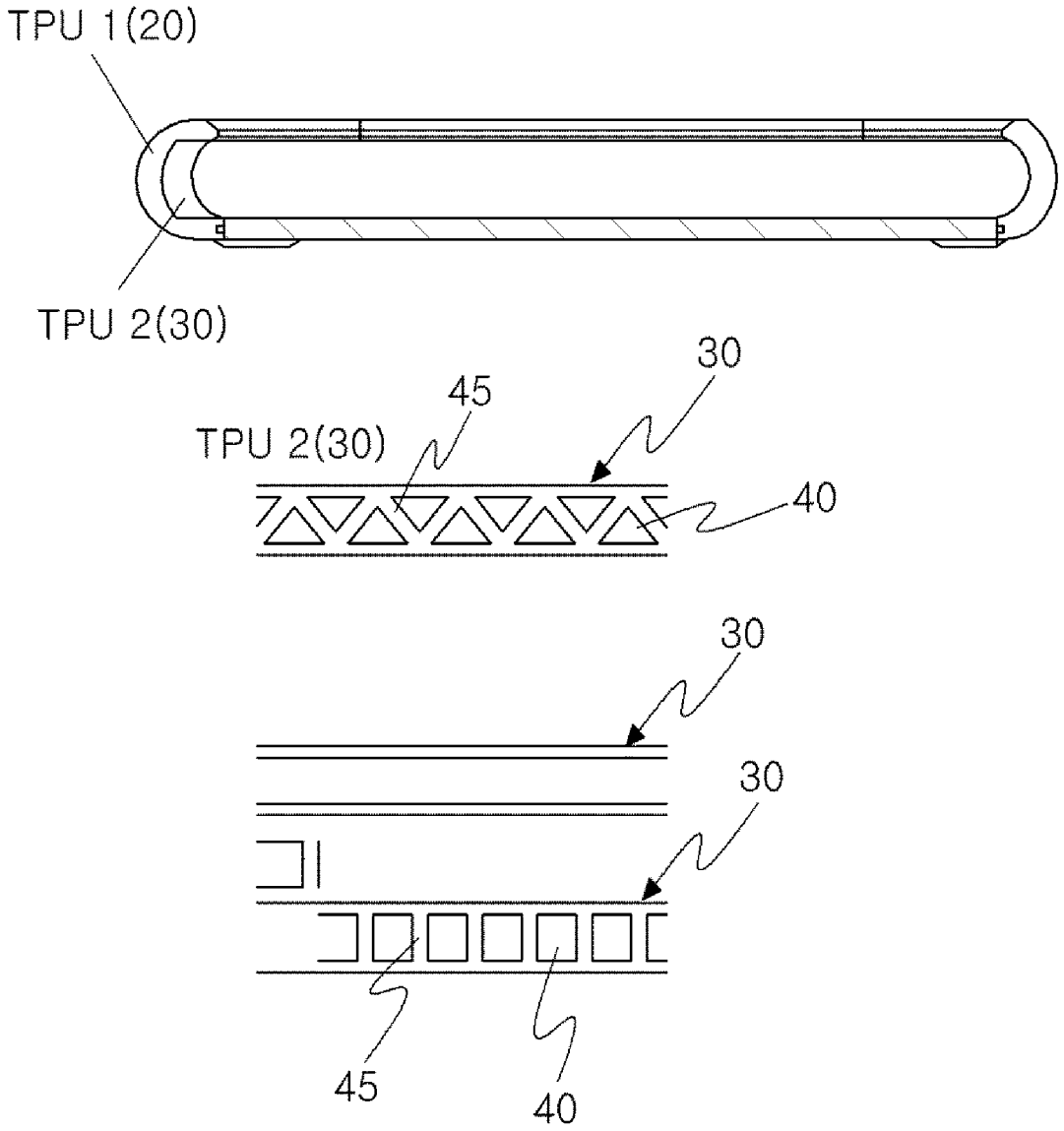
FIG. 14 shows alternative ways of the whole structure according to the present invention.

In still another alternative as in FIG. 14, the insert member 30 further comprises a top wall 33 and a bottom, wall 34 so that the insert member 30 forms a tube formed by the inner and outer walls 31, 32, and the top and bottom walls.

The longitudinal insert member 30 significantly covers the side portion 210 of the electronic device 200 as in various figures. More preferably, the longitudinal insert member 30 covers the corners of the side wall 20 of the protective cover 10 because the corners are especially vulnerable to impact or shock. The side wall 20 of the protective cover 10 continuously wraps around the side portion 210 of the electronic device 200 to apply pressure toward a direction of the electronic device 200. By this structure, the electronic device 200 can be securely secured in the side wall 20.

The insert member 30 may have a protrusion 70 and the side wall 20 of the protective cover 10 may have a mating recess 75 such that the protrusion 70 is received by or mated with the mating recess 75.

In the alternative, the side wall 20 of the protective cover 10 may have a protrusion 70 and the insert member 30 may have a mating recess 75 such that the protrusion 70 is received by or mated with the mating recess 75.

Figure 10:
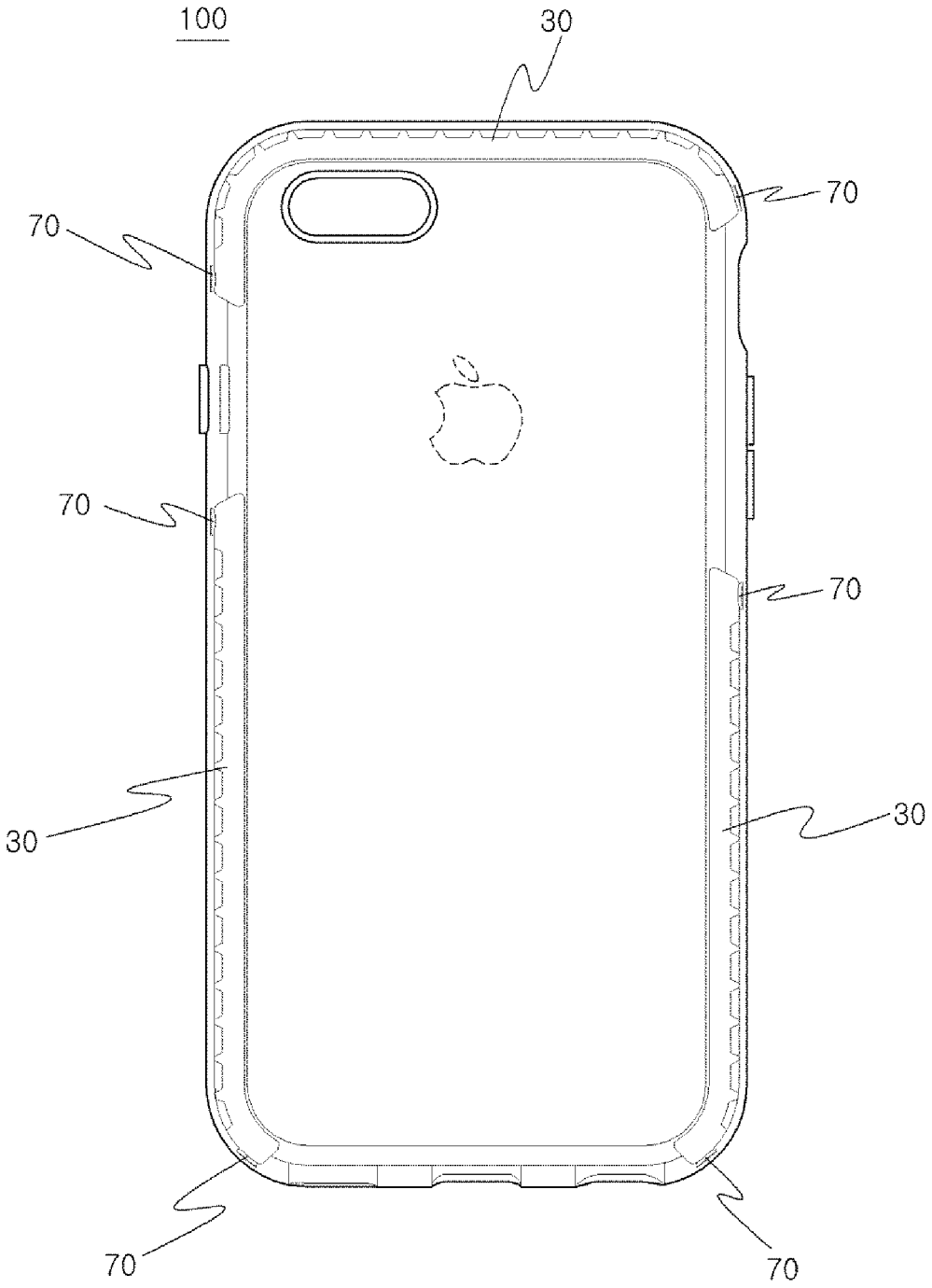
FIG. 10 shows a rear view of the case.
Figure 11A:
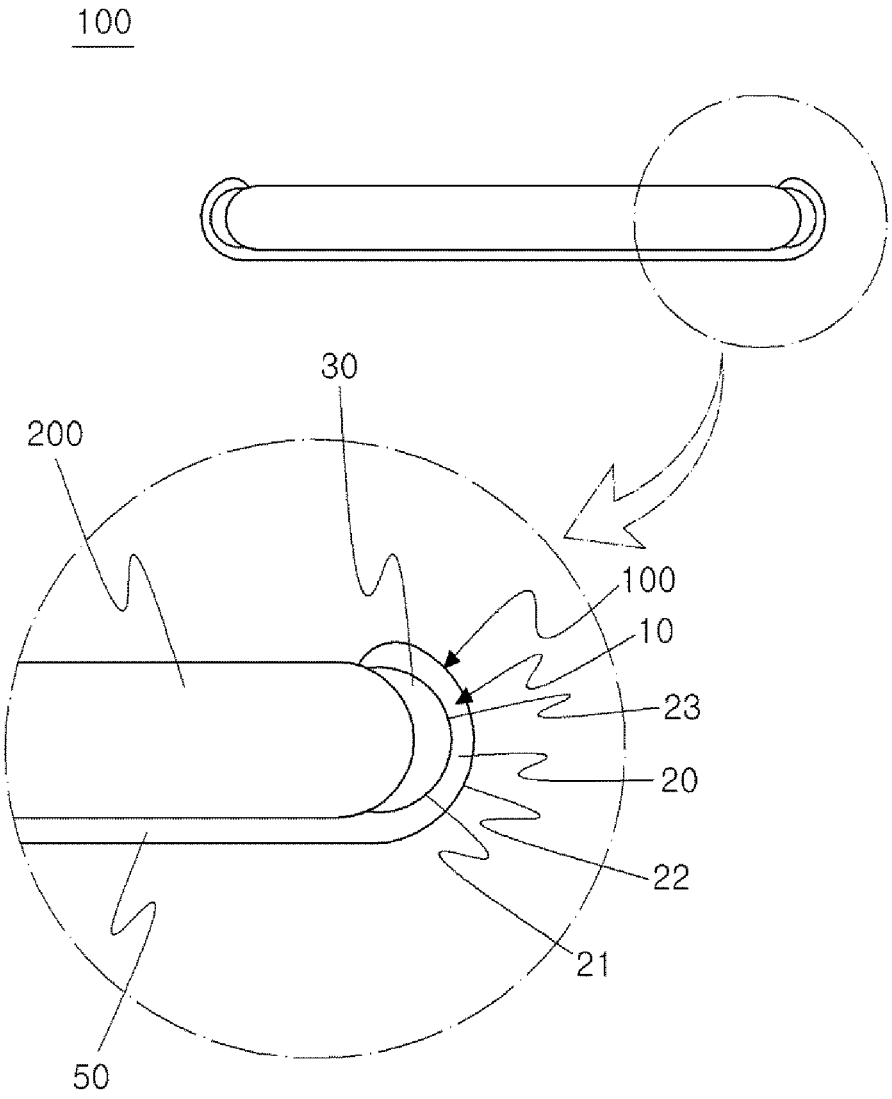
FIGS. 11A and 11B show cross sectional views—including enlarged cross sectional views—of the case.
Figure 11B:
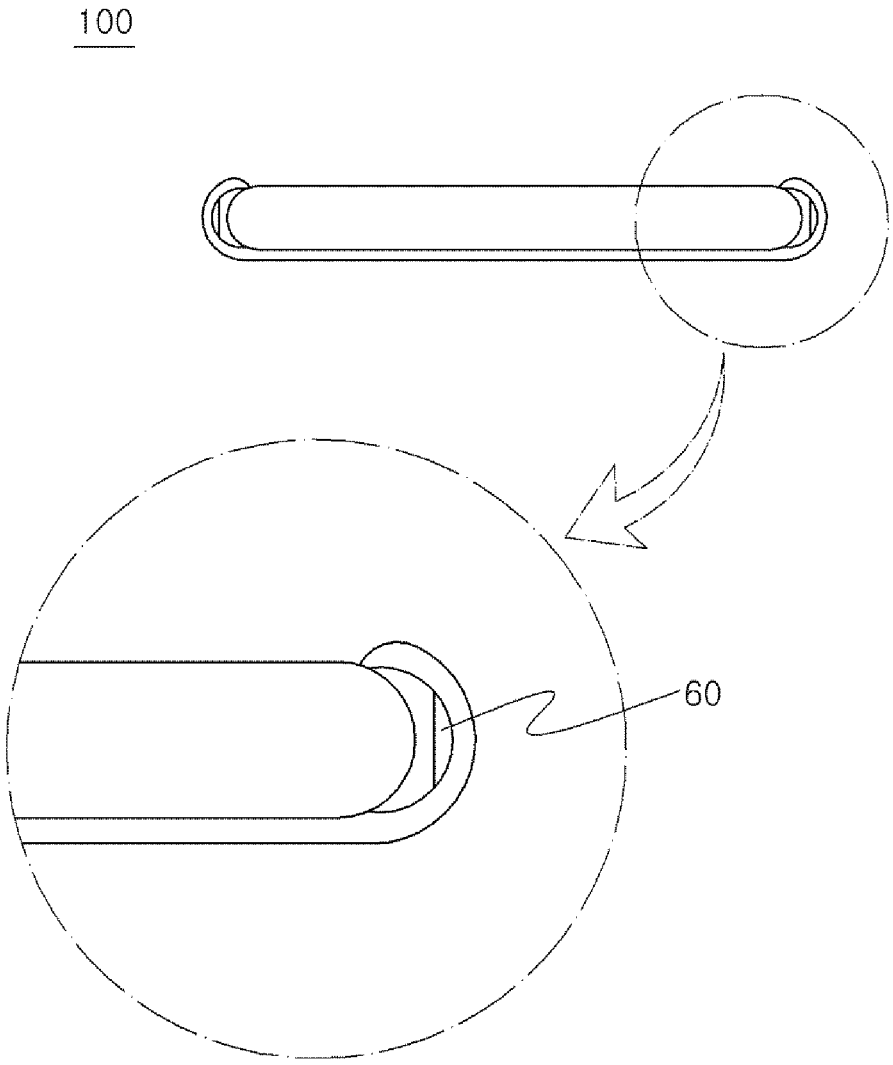
Figure 12:
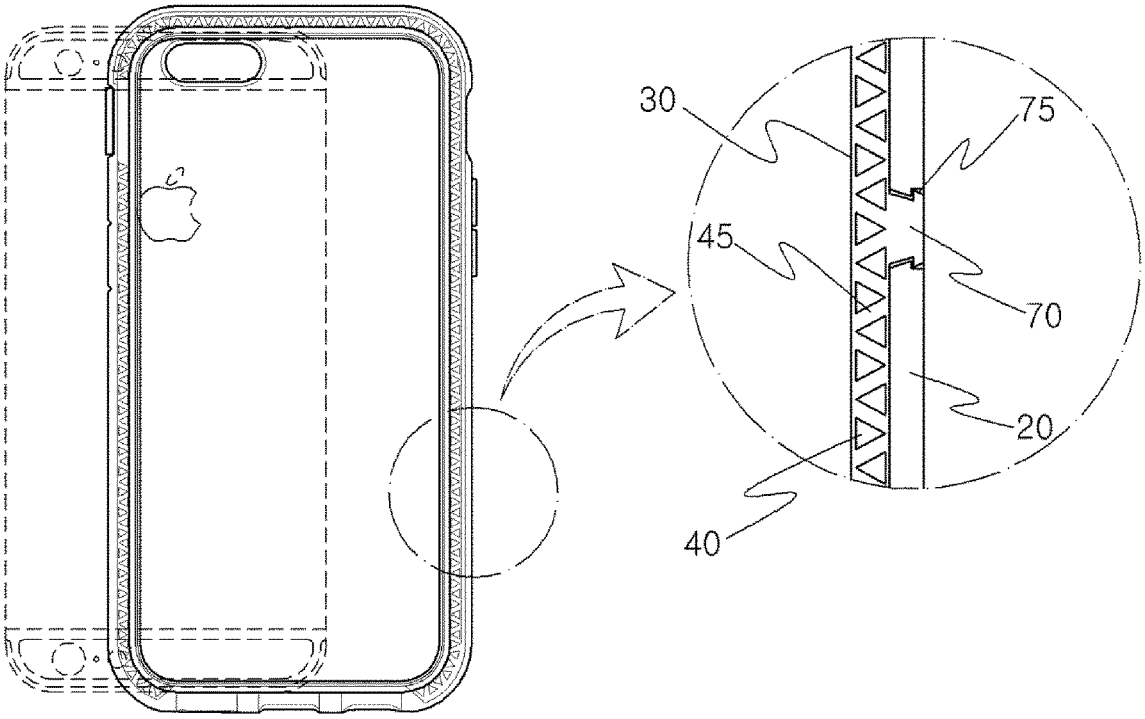
FIG. 12 shows the present invention illustrating the coupling structure between the first and second thermoplastic polyurethane layers.
Figure 13:
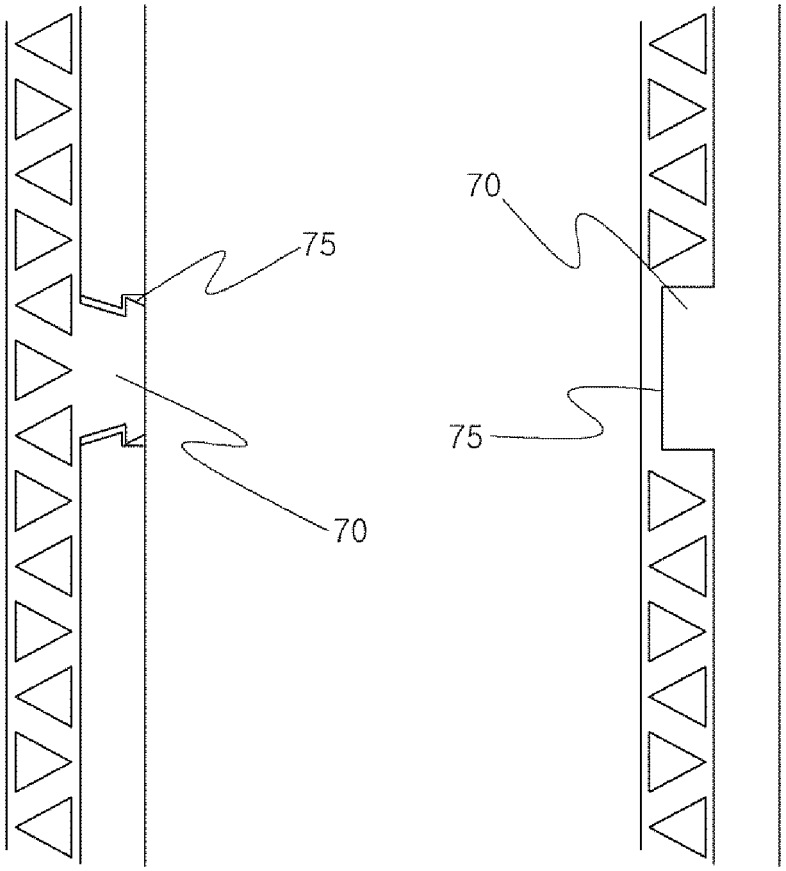
FIG. 13 shows alternative ways of the coupling structure between the first and second thermoplastic polyurethane layers.

Preferably, there are four, six or eight couplings of the protrusion 70 and the mating recess 75, for example, as in FIG. 10.

By this coupling of the protrusion 70 and the mating recess 75, the insert member 30 does not slide along the side wall 20 or is not easily detached from the side wall 20. By this coupling structure, the insert member 30 can be removably or detachably received in the side wall 20 of the protective cover 10.

In the alternative, the longitudinal insert member 30 may be fixedly attached to the side wall 20 of the protective cover 10 by an attachment means such as glue, glue, bond, paste, tape, double-sided adhesive, etc.

The side wall 20 of the protective cover 10 is made of thermoplastic polyurethane (TPU). The longitudinal insert member 30 is made of thermoplastic polyurethane (TPU). Or, the insert member 30 may be made of thermoplastic elastomers (TPE), silicon or other soft flexible material known in the art.

The longitudinal insert member 30 and the side wall 20 of the protective cover 10 may be manufactured separately and detachably attached to each other by the coupling structure. Alternatively, the longitudinal insert member 30 and the side wall 20 of the protective cover 10 may be made by a double shot injection molding, thereby the longitudinal insert member 30 is fixedly attached to the side wall 20.

The side wall 20 of the protective cover 10 is transparent, semi-transparent, translucent or opaque. More preferably, the side wall 20 of the protective cover 10 may have a color of white or smoke white (transparent or translucent). The longitudinal insert member 30 may have a vivid color visible through the side wall 20 which is preferably transparent or translucent.

The protective cover 10 may further comprises a back plate 50 for significantly covers a back portion 220 of the electronic device 200 wherein the protective cover 10 does not significantly cover a front portion 230 of the electronic device 200. The front portion 230 usually has a screen.

The back plate 50 may be made by thermoplastic polyurethane so that the side wall 20 and the back plate 50 can be made as one. Alternatively, the back plate 50 may be made of transparent, translucent or opaque plastic and the protective cover 10 may be made by a double shot injection molding, wherein the back plate 50 is made by a first shot injection molding and the side wall 20 is made by a second shot injection molding onto the back plate 50 along edges of the back plate 50.

In another alternative, the back plate 50 may be made by cutting a plate and then, the side wall 20 is made by injection, molding onto the back plate 50 along edges of the back plate 50. The back plate 50 may be made of polycarbonate or acryl.

Figure 7:
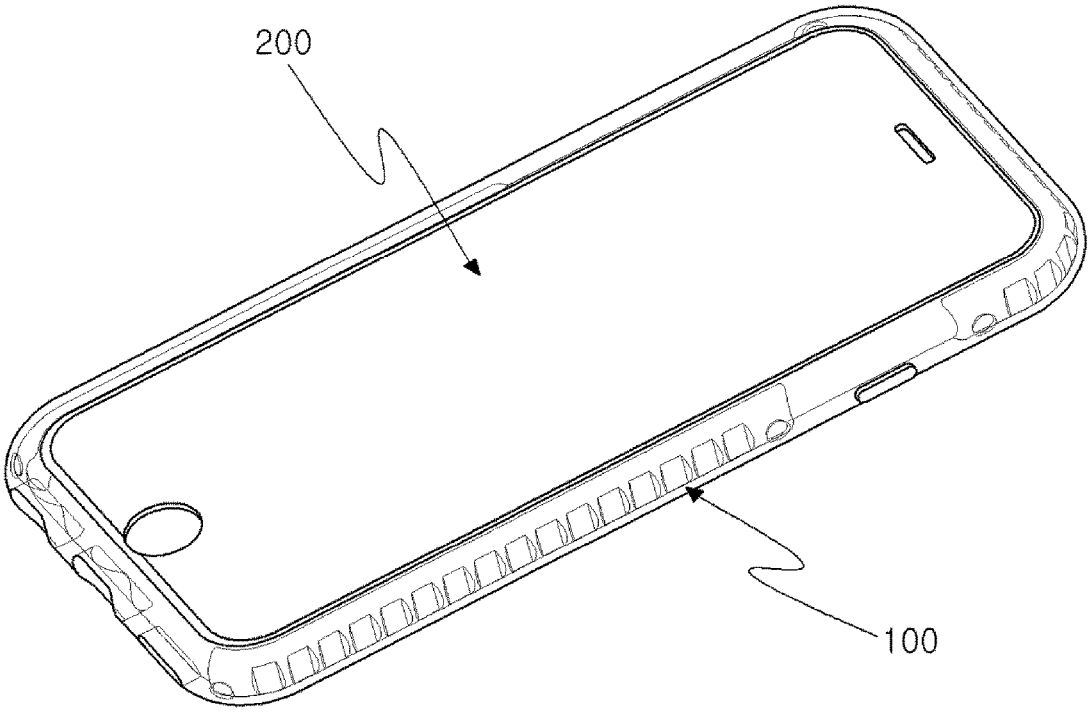
FIG. 7 shows a perspective view of a case and an electronic device installed therein according to still another embodiment of the present invention.

FIGS. 7~11B show still another embodiment of the present invention. FIG. 7 shows a perspective view of the case 100 and electronic device 200 installed therein. FIGS. 8~11B respectively show perspective, front, rear, and cross-sectional views including enlarged views.

The case 100 for an electronic device 200 comprises: a protective cover 10 having a side wall 20 wherein, the side wall 20 significantly covers a side portion 210 of the electronic device 200 and the side wall 20 comprises an inner surface 21 and an outer surface 22 wherein the inner surface 21 faces the electronic device 200 and a longitudinal recess 23 is formed on the inner surface 21; and a longitudinal insert member 30 removably received in the recess 23. The longitudinal insert member 30 comprises an inner surface 31 and an outer surface 32 and the inner surface 31 of the insert member 30 faces the electronic device 200. The outer surface 32 of the longitudinal insert member 30 is provided with a plurality of depressions 60 longitudinally arranged. In addition, the depressions 60 are separated by a plurality of partitions 65 and form spaces between the inner surface 21 of the side wall 20 and the outer surface 32 of the insert member 30. The spaces formed by the depressions 60 play the role of air cushion to absorb impact or shock.

The inner surface 21 of the side wall 20 is in contact with the outer surface 32 of the longitudinal insert member 30. In addition, both of the inner surface 21 of the side wall 20 and the outer surface 32 of the longitudinal insert member 30 are curved as in the figures. However, the spaces formed by the depressions 60 are gaps between the inner surface 21 of the side wall 20 and the outer surface 32 of the longitudinal insert member 30 and in the spaces, the inner surface 21 of the side wall 20 and the outer surface 32 of the longitudinal insert member are not in contact with each other. The spaces formed by the depressions 60 play the role of air cushion to absorb impact or shock.

Figure 8:
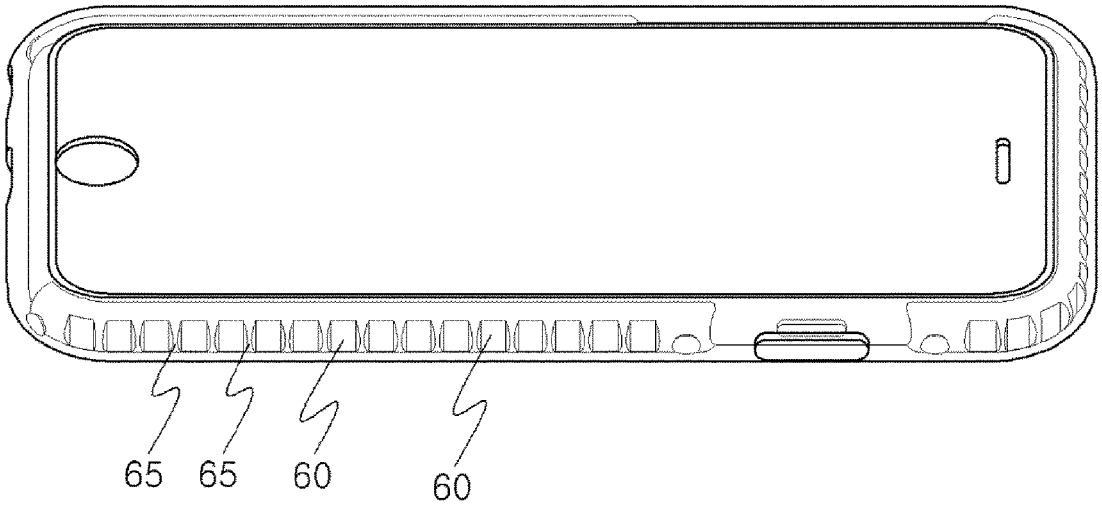
FIG. 8 shows another perspective view of the case and an enlarged view thereof.
Figure 8:
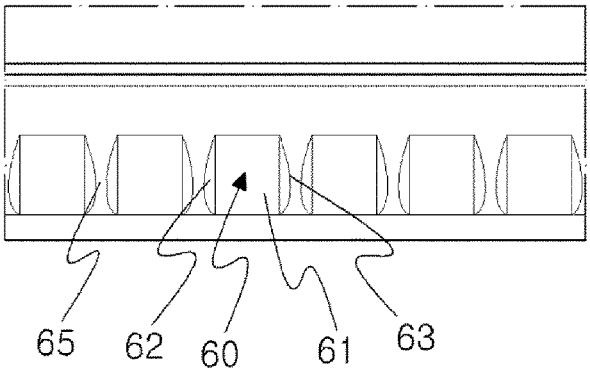
Figure 9:
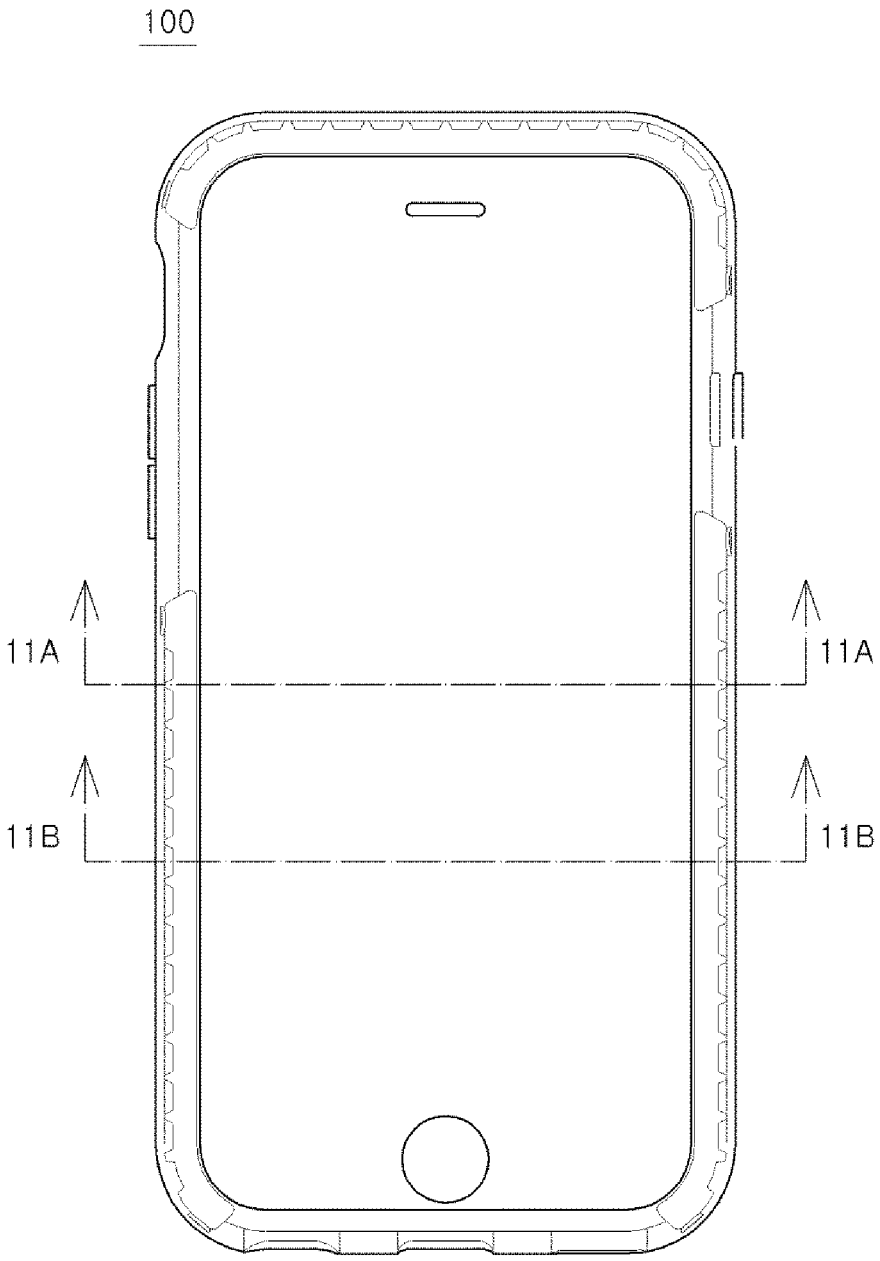
FIG. 9 shows a front view of the case.

As in FIG. 8, the depression 60 preferably comprises a rectangular base 61 and two arch-shaped side surfaces 62, 63 such that the depressions 60 form a series of substantially symmetrical depressions 60 separated by the partitions 65.

The longitudinal insert member 30 significantly covers the side portion 210 of the electronic device 200. The side wall 20 of the protective cover 10 continuously wraps around the side portion 210 of the electronic device 200 to apply pressure toward a direction of the electronic device 200. Preferably, the longitudinal insert member 30 covers the corners of the side wall 20 of the protective cover 10 since the corners are especially vulnerable to impact or shock.

The longitudinal insert member 30 may have a protrusion 70 and the side wall 20 of the protective cover 10 may have a mating hole 75 such that the protrusion 70 is received by or mated with the mating hole 75. Preferably, there are four, six or eight couplings of the protrusion 70 and the mating hole 75.

In the alternative, the longitudinal insert member 30 may have a protrusion 70 and the side wall 20 of the protective cover 10 may have a mating recess 75 such that the protrusion 70 is received by or mated with the mating recess 75. Both couplings with the mating hole or mating recess may be used.

In the alternative, the side wall 20 of the protective cover 10 may have a protrusion 70 and the longitudinal insert member 30 may have a mating recess 75 such that the protrusion 70 is received by or mated with the mating recess 75.

Preferably, the longitudinal insert member 30 is removably or detachably received in the side wall 20 of the protective cover 10.

The longitudinal insert member 30 may be fixedly attached to the side wall 20 of the protective cover 10 by an attachment means such as glue, glue, bond, paste, tape, double-sided adhesive, etc.

The side wall 20 of the protective cover 10 is made of thermoplastic polyurethane (TPU). The longitudinal insert, member 30 is made of thermoplastic polyurethane (TPU). Or, the insert member 30 may be made of thermoplastic elastomers (TPE), silicon, or other soft flexible material known in the art.

The longitudinal Insert member 30 and the side wall 20 of the protective cover 10 may be manufactured separately, or the longitudinal insert member 30 and the side wall 20 of the protective cover 10 may be made by a double shot injection molding.

The side wall 20 of the protective cover 10 is transparent, semi-transparent, translucent or opaque. The side wall 20 of the protective cover 10 may have a color of white or smoke white. The insert member 30 may have a vivid color visible through the side wall 20, which is preferably transparent or translucent.

The protective cover 10 may further comprise a back plate 50 for significantly covers a back portion 220 of the electronic device 200 wherein the protective cover 10 does not significantly cover a front portion 230 of the electronic device 200.

The back plate 50 and the side wall 20 may be made together by thermoplastic polyurethane. Alternatively, the back plate 50 is made of transparent, translucent or opaque plastic and the protective cover 10 may be made by a double shot injection molding, wherein the back plate 50 is made by a first shot injection molding and the side wall 20 is made by a second shot injection molding onto the back plate 50 along edges of the back plate 50.

Alternatively, the hack plate 50 may be made by cutting a plate and then, the side wall 20 is made by injection molding onto the back plate 50 along edges of the back plate 50. The back plate may be made of polycarbonate or acryl.

Figure 15A:
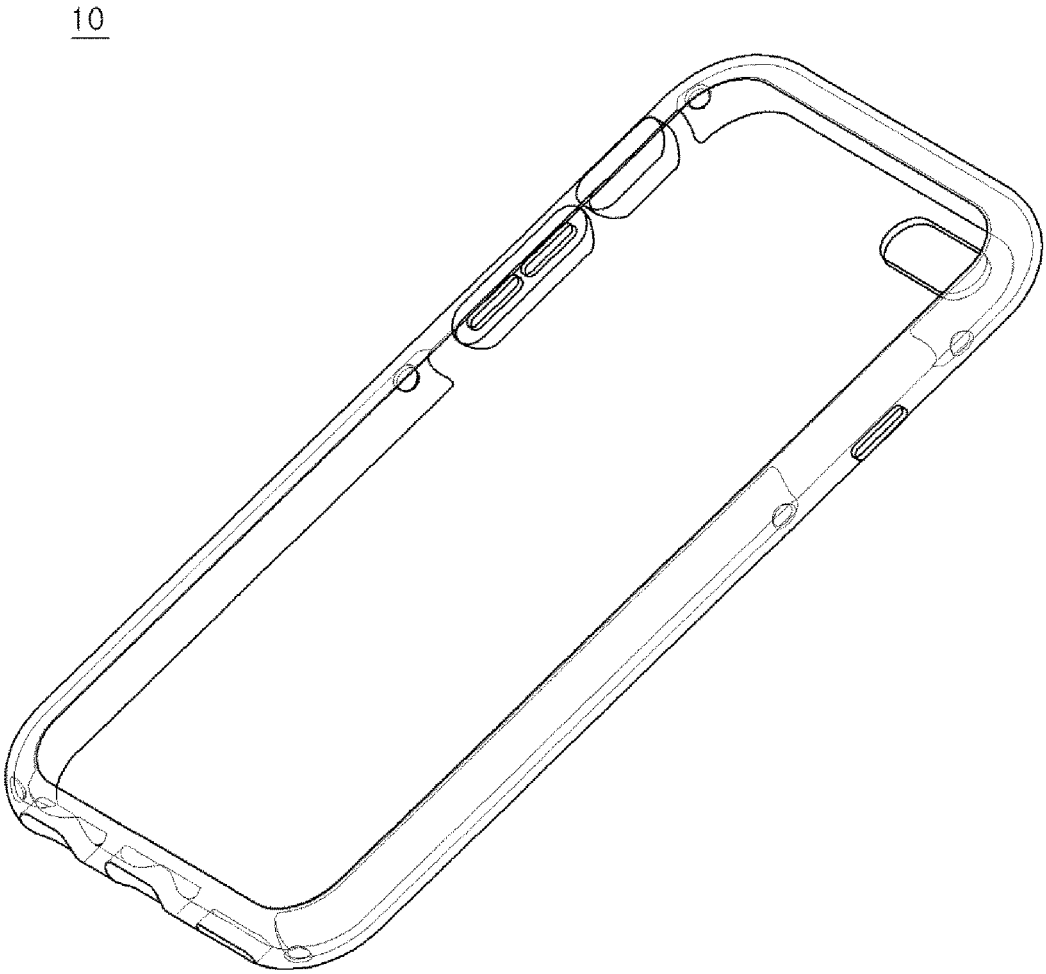
FIGS. 15A, 15B, 15C and 15D show the protective cover of the present invention showing retaining members.
Figure 15B:
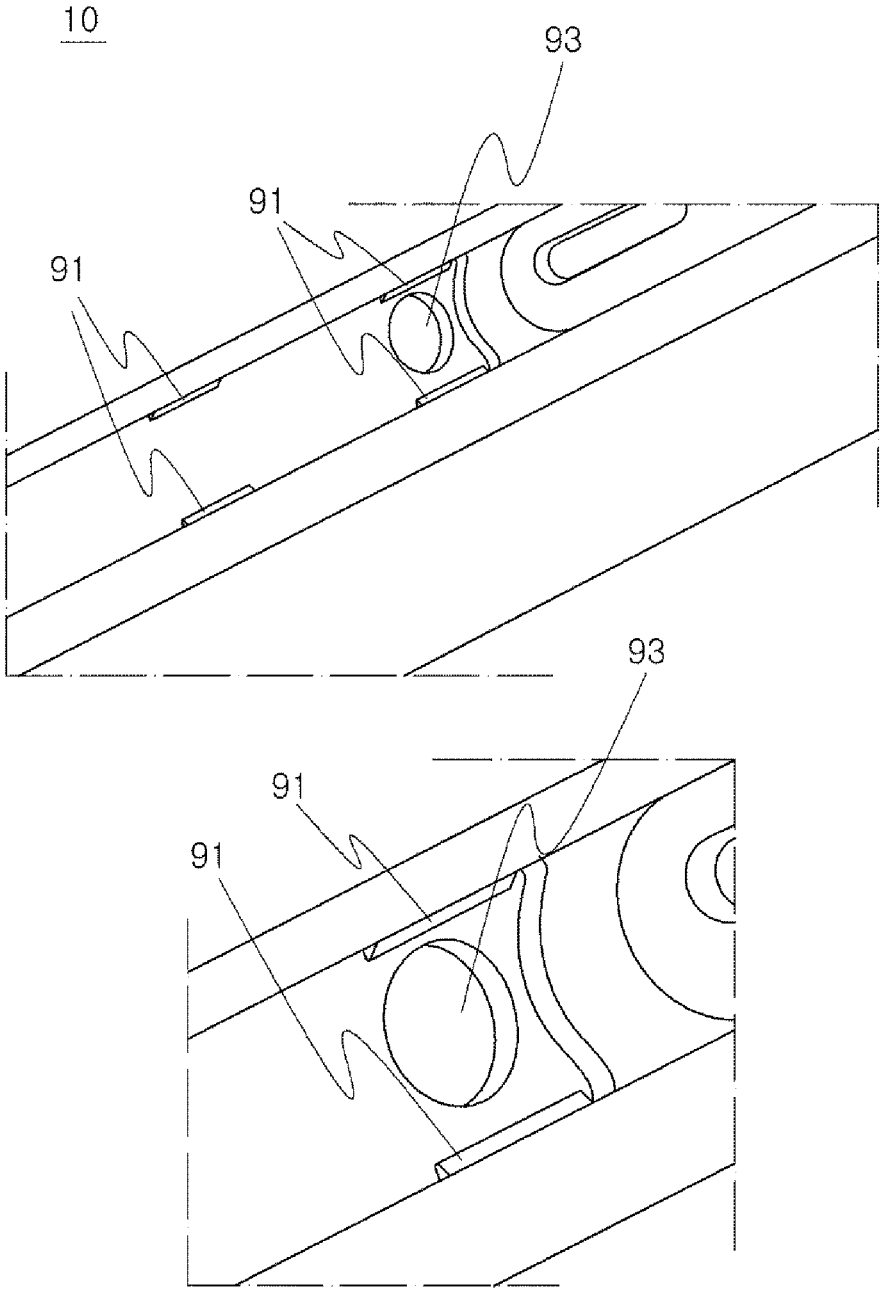
Figure 15C:
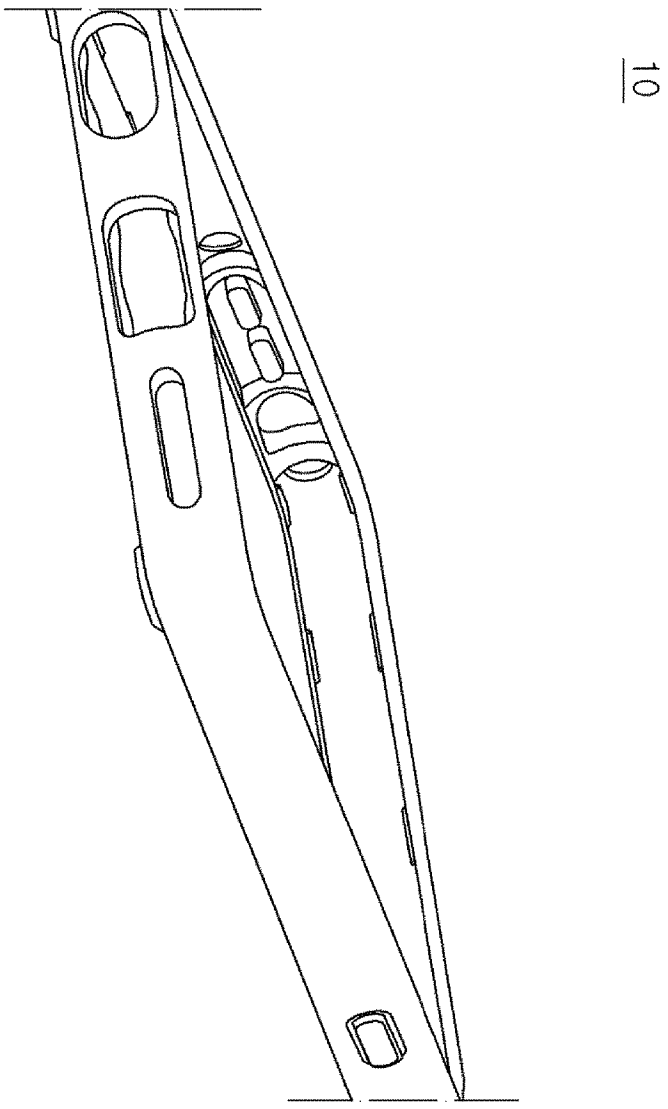
Figure 15D:
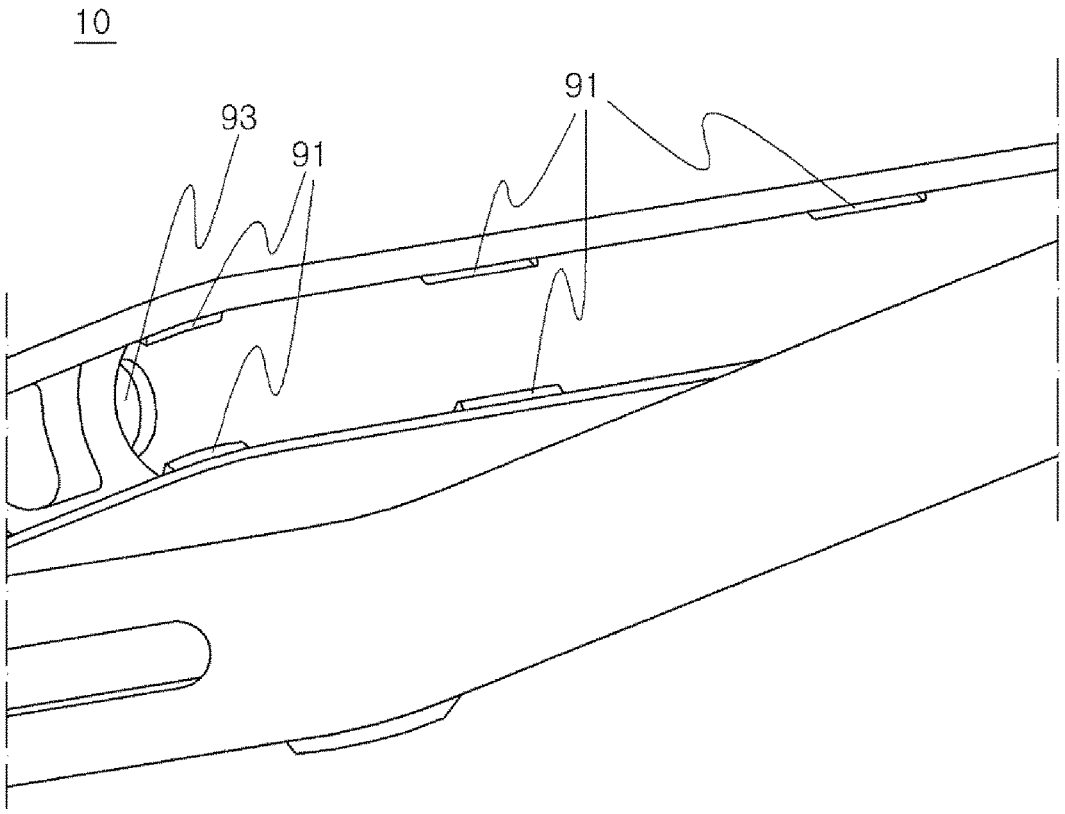

FIGS. 15A, 15B, 15C, and 15D show the protective cover 10 of the present invention 100 showing retaining members 91. FIGS. 15B and 15D are respectively enlarged views of FIGS. 15A and 15C.

The protective cover 10 further comprises a pair of retaining members 91 formed on both edges of the inner surface 21 of the protective cover 10 wherein the retaining members 91 are constructed to allow insertion of the longitudinal insert member 30 into the longitudinal recess 23, but make removal of the longitudinal insert member 30 from the longitudinal recess 23 hard.

Preferably, the retaining members 91 are longitudinal protrusions or ribs formed on edges of the inner surface 21. Additionally, the longitudinal insert member 30 may have recess portions (not shown) to receive the retaining members therein. The coupling between the retaining member 91 and the recess portion makes harder removal of the longitudinal insert member 30 from the longitudinal recess 23.

The inner surface 21 is outwardly rounded and the retaining members 91 are outwardly slanted. Thus, the insert member 30 can be inserted into the longitudinal recess 23 by deforming the retaining members 91. Once the longitudinal insert member 30 is retained in the longitudinal recess 23, it is not easy to remove the longitudinal insert member 30 from the longitudinal recess 23 because of the retaining members 91.

The retaining members are preferably made together with the side wall 20 and made of TPU. As in FIG. 15A or FIG. 15C, there are a plurality of pairs of retaining members 91 formed along both edges of the inner surface 21. Additionally, there are a plurality of pairs of corresponding recess portions formed on the insert member 30.

Figure 16A:
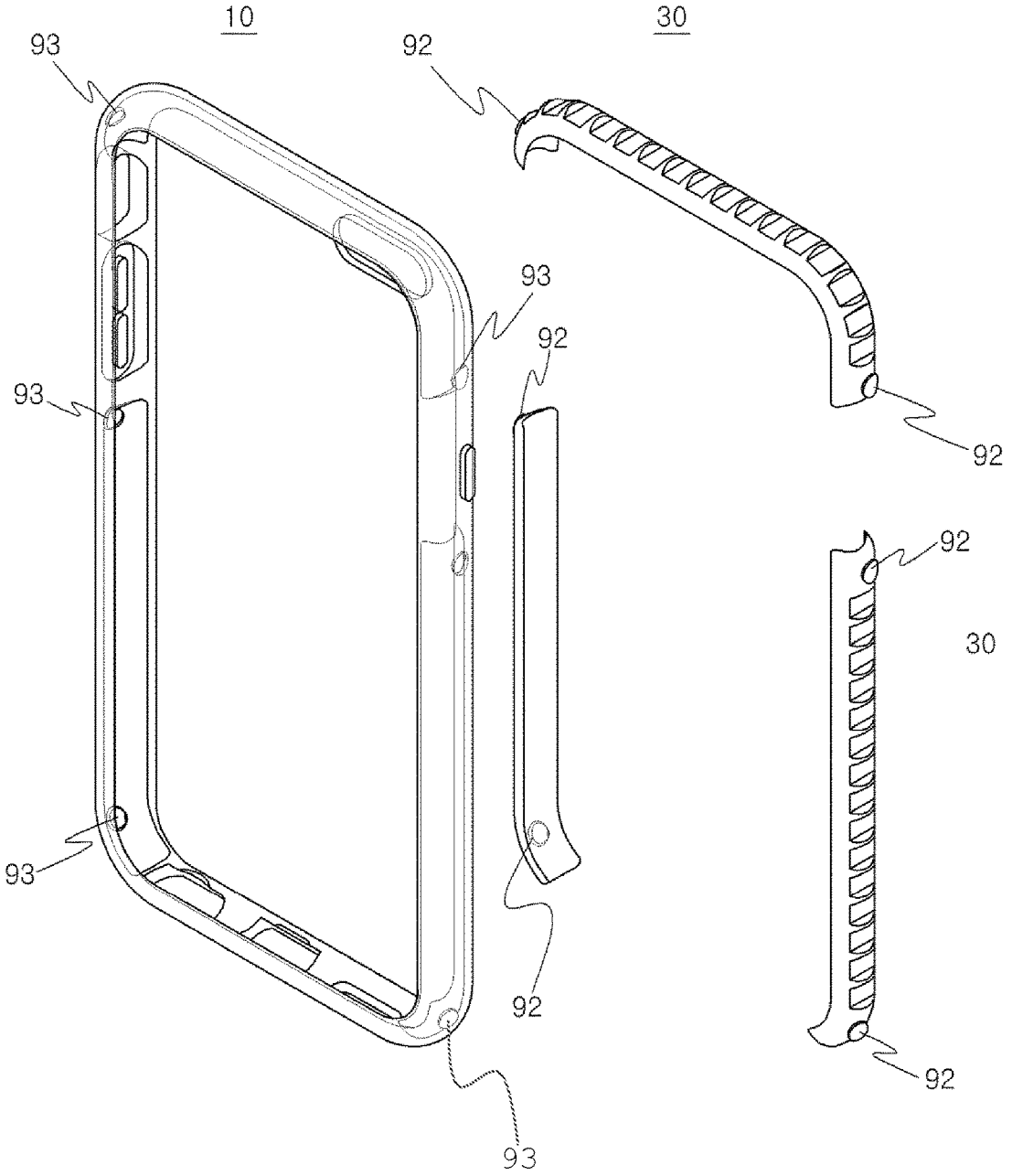
FIGS. 16A and 16B respectively show exploded and assembled views of the present invention showing how the protective cover and three longitudinal insert members assemble together.
Figure 16B:
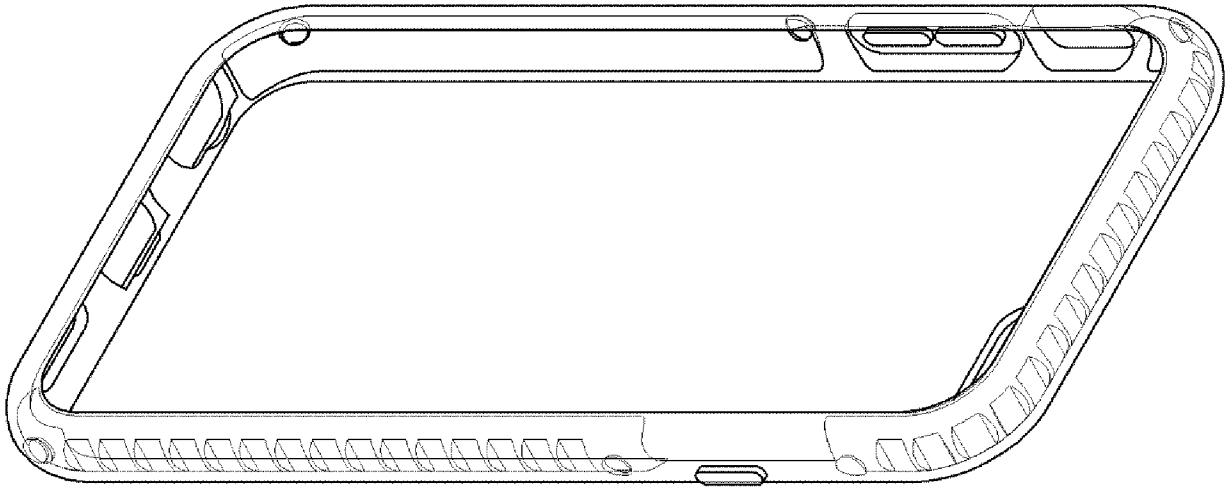

FIGS. 16A and 16B respectively show exploded and assembled view of the present invention showing how the protective cover 10 and three insert members 30 assemble together.

A case 100 for an electronic device 200 comprises: a protective cover 10 having a side wall 20 wherein the side wall 20 significantly covers a side portion 210 of the electronic device 200 and the side wall 20 comprises an inner surface 21 and an outer surface 22 wherein the inner surface 21 faces the electronic device 200 and a longitudinal recess 23 is formed on the inner surface 21; and an longitudinal insert member 30 removably received in the recess 23.

The protective cover 10 further comprises a pair of retaining members 91 formed on both edges of the inner surface 21 of the protective cover 10 wherein the retaining members 91 are constructed to allow insertion of the longitudinal insert member 30 into the longitudinal recess 23, but make removal of the longitudinal insert member 30 from the longitudinal recess 23 hard.

The retaining members 91 are longitudinal protrusions slanted toward a direction of the outer surface 22 of the protective cover 10. In addition, the longitudinal insert member 30 may further comprise a couple of recess portions to receive the retaining members 91 therein.

The longitudinal insert member 30 is longitudinal and the longitudinal insert member 30 comprises an inner wall 31 and an outer wall 32 wherein the inner wall 31 faces the electronic device 200.

The longitudinal insert member 30 may further comprise a couple of coupling protrusions 92 formed on both ends of the insert member 30, and a couple of coupling recesses 93 may be formed on the inner surface 21 of the protective cover 10, wherein the couple of the coupling recesses 93 respectively receive the couple of the coupling protrusions 92 for secure retention of the longitudinal insert member 30 in the longitudinal recess 23. The coupling recesses 93 are formed on both ends of the recess 23.

In the alternative, the longitudinal insert member 30 may further comprise a couple of coupling recesses 93 formed on both ends of the insert member 30, and a couple of coupling protrusions 92 may be formed on the inner surface 21 of the protective cover 10, wherein the couple of the coupling recesses 93 respectively receive the couple of the coupling protrusions 92 for secure retention of the longitudinal insert member 30 in the longitudinal recess 23.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A case (100) for an electronic device (200), comprising:

a protective cover (10) having a side wall (20) wherein the side wall (20) significantly covers a side portion (210) of the electronic device (200) and the side wall (20) comprises an inner surface (21) and an outer surface (22) wherein the inner surface (21) faces the electronic device (200) and a longitudinal recess (23) is formed on the inner surface (21); and a longitudinal insert member (30) removably received in the longitudinal recess (23), wherein the longitudinal insert member (30) comprises an inner wall (31) and an outer wall (32), wherein the inner wall (31) faces the electronic device (200) and is disposed between the electronic device and the outer wall, wherein the longitudinal insert member (30) is provided with a plurality of holes (40), and wherein the holes (40) are separated by a plurality of partitions (45), and the holes (40) are formed by the inner and outer walls (31), (32) and the partitions (45) such that the holes (40) pass through the longitudinal insert member (30).

2. The case of claim 1, wherein the inner and outer walls (31), (32) of the longitudinal insert member (30) are substantially parallel to each other, wherein the holes (40) have a trapezoidal or substantially trapezoidal cross section so that the holes (40) form a series of trapezoidal or substantially trapezoidal holes (40).

3. The case of claim 1, wherein the inner and outer walls (31), (32) of the longitudinal insert member (30) are substantially parallel to each other, wherein the holes (40) have a triangular or substantially triangular cross section so that the holes (40) form a series of triangular or substantially triangular holes (40).

4. The case of claim 1, wherein the inner and outer walls (31), (32) of the longitudinal insert member (30) are substantially parallel to each other, wherein the holes (40) have a rectangular or substantially rectangular cross section so that the holes (40) form a series of rectangular or substantially rectangular holes (40).

5. The case of claim 1, wherein the side wall (20) of the protective cover (10) continuously wraps around the side portion (210) of the electronic device (200) to apply pressure toward a direction of the electronic device (200).

6. The case of claim 5, wherein the longitudinal insert member (30) significantly covers the side portion (210) of the electronic device (200) and covers a corner of the side wall (20) of the protective cover (10).

7. The case of claim 5, wherein the protective cover (10) further comprises a back plate (50) that significantly covers a back portion (220) of the electronic device (200) wherein the protective cover (10) does not significantly cover a front portion (230) of the electronic device (200), wherein the back plate (50) is made of transparent or translucent plastic.

8. The case of claim 7, wherein the protective cover (10) is made by a double shot injection molding, wherein the back plate (50) is made by a first shot injection molding and the side wall (20) is made by a second shot injection molding onto the back plate (50) along edges of the back plate (50).

9. The case of claim 7, wherein the back plate (50) is made by cutting a plate and then, the side wall (20) is made by injection molding onto the back plate (50) along edges of the back plate (50).

10. The case of claim 5, wherein the side wall (20) of the protective cover (10) is made of thermoplastic polyurethane (TPU), and wherein the longitudinal insert member (30) is made of thermoplastic polyurethane (TPU), thermoplastic elastomers (TPE), or silicon.

11. The case of claim 5, wherein the side wall (20) of the protective cover (10) is transparent, semi-transparent, or translucent.

12. The case of claim 5, wherein the side wall (20) of the protective cover (10) has a color of white or smoke white.

13. The case of claim 1, wherein the longitudinal insert member (30) has a protrusion (70) and the side wall (20) of the protective cover (10) has a mating recess (75) such that the protrusion (70) is received by or mated with the mating recess (75).

14. The case of claim 1, wherein the protective cover (10) further comprises a pair of retaining members (91) formed on opposite edges of the inner surface (21) of the protective cover (10) wherein the retaining members (91) are constructed to allow insertion of the longitudinal insert member (30) into the longitudinal recess (23), but make removal of the longitudinal insert member (30) from the longitudinal recess (23) hard, wherein the retaining members (91) are longitudinal protrusions slanted toward a direction of the outer surface (22) of the protective cover (10), wherein the longitudinal insert member (30) further comprises a couple of recess portions to receive the retaining members (91) therein.

* * * * *